US009677271B2

(12) United States Patent
Forbes

(10) Patent No.: US 9,677,271 B2
(45) Date of Patent: Jun. 13, 2017

(54) CONCRETE UNIT AND METHODS

(71) Applicant: Anchor Wall Systems, Inc., Minnetonka, MN (US)

(72) Inventor: Nicole Rae Forbes, Eagan, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 14/878,695

(22) Filed: Oct. 8, 2015

(65) Prior Publication Data

US 2017/0101780 A1 Apr. 13, 2017

(51) Int. Cl.
*E04B 5/04* (2006.01)
*E04C 2/30* (2006.01)
*E04C 2/04* (2006.01)

(52) U.S. Cl.
CPC ..... *E04C 2/30* (2013.01); *E04C 2/044* (2013.01)

(58) Field of Classification Search
CPC ..... E04C 2/30; E04C 2/044
USPC ..... 52/604; 404/41
See application file for complete search history.

(56) References Cited

U.S. PATENT DOCUMENTS 130,027 A * 7/1872 Dyer ..... E01C 5/00 404/38
345,726 A * 7/1886 Promoli ..... E01C 5/00 404/41
1,032,858 A * 7/1912 Pettit ..... E01C 5/00 404/41
1,984,393 A * 12/1934 Brown ..... E04B 2/04 52/284
3,635,459 A 1/1972 Mare
3,873,225 A * 3/1975 Jakobsen ..... E01C 5/00 404/41
4,310,994 A 1/1982 Gephardt
4,711,606 A 12/1987 Leling et al.
5,028,167 A * 7/1991 Scheiwiller ..... E01C 5/00 404/38
5,035,098 A 7/1991 Newsom
5,254,058 A 10/1993 Savigny
6,178,715 B1 * 1/2001 Pacitto ..... E04C 1/395 405/264
6,263,633 B1 * 7/2001 Hagenah ..... B28B 7/0064 404/34
6,455,113 B1 * 9/2002 Bilodeau ..... B44C 3/123 362/147
6,668,484 B2 * 12/2003 Riccobene ..... A01G 1/08 256/19
7,849,656 B2 * 12/2010 Mugge ..... E02D 17/20 405/284
8,100,608 B2 * 1/2012 Steffen ..... E02D 17/20 405/284

* cited by examiner

*Primary Examiner* — Basil Katcheves
(74) *Attorney, Agent, or Firm* — Merchant & Gould P.C.

(57) ABSTRACT

A concrete unit includes a six sided body having three pairs of opposed rectangular faces. Two opposed faces each has an irregular three dimensional pattern extending across the entire face to provide two aesthetic faces on the unit. The two opposed faces have patterns that are mirror images of each other such that when two of the units are placed with their patterned faces aligned and in contact, the three dimensional patterns on the opposed faces nest to minimize the space between the adjacent edges of the units. The concrete units may be used as steps or in other applications.

17 Claims, 4 Drawing Sheets

CONCRETE UNIT AND METHODS

TECHNICAL FIELD

This disclosure concerns concrete units and methods of making and using such units. Specifically, this disclosure pertains to concrete blocks that, when assembled, give a seamless appearance.

BACKGROUND

Concrete units can be used in a variety of applications. For example, concrete units can be used for building steps along a hillside to help people more easily traverse the hillside.

It is often desirable to include aesthetically pleasing texturized patterns in the exposed face that forms a riser of a step, and in some applications, in the top face as well. At the top or bottom of the steps, multiple concrete units are often placed together to form a landing. One problem encountered if the riser has a texturized appearance is that the joint between adjacent concrete units may not be aesthetic because the joint is wider than desired. A wider joint could be a tripping hazard, or it could be non-compliant with the Americans with Disabilities Act. Therefore, there is a need for concrete units that can form aesthetically pleasing steps and which allow for the forming of a joint with an adjacent concrete unit that is seamless in appearance.

SUMMARY

In one aspect, a concrete unit is provided including a 6-sided body having three pairs of opposed rectangular faces. Two opposed faces of a first pair of opposed faces of the body each has an irregular three dimensional pattern extending across the entire face to provide two aesthetic faces on the unit. The two opposed faces have patterns that are mirror images of each other such that when two of the units are placed with their patterned faces aligned and in contact, the three dimensional patterns on the opposed faces nest to minimize the space between adjacent edges of the units.

In preferred embodiments, at least one of the faces of a second pair of opposed faces is straight, flat, and without a projection extending therefrom.

One of the faces of the second pair of opposed faces may be textured.

In preferred embodiments, a third pair of opposed faces are straight, flat, and without a projection extending therefrom.

The faces of the third pair of opposed faces may be parallel to each other.

One of the faces of the second pair of opposed faces may be textured, and the faces of the third pair of opposed faces are preferably planar.

In many implementations, the first pair of opposed faces comprise front and back faces, with at least one of the front and back faces being an exposure face; and the second pair of opposed faces comprise top and bottom faces and extend between the front and back faces.

In preferred embodiments, the six sided body has no more than six sides.

In preferred embodiments, the six sided body is solid and core-free.

In preferred implementations, the six sided body comprises a molded dry cast concrete unit.

In another aspect, a set of concrete units is provided. The set of concrete units includes a first concrete unit and a second concrete unit. Each of the first concrete unit and second concrete unit includes a six sided body having three pairs of opposed rectangular faces. At least one of the faces has an irregular three dimensional pattern extending across the entire face to provide an aesthetic face on the unit. The patterned face on the first concrete unit and the patterned face on the second concrete unit are mirror images of each other such that when the first unit and second unit are placed with their pattern faces aligned and in contact, the three dimensional patterns on the aligned faces nest to minimize the space between adjacent edges of the first and second units.

In preferred implementations, each of the first concrete unit and second concrete unit is as characterized above.

In another aspect, a method of assembling a concrete arrangement is provided. The method includes providing a first concrete unit and a second concrete unit. Each of the first concrete unit and second concrete unit comprises a six sided body having three pairs of opposed rectangular faces, with at least one of the faces having an irregular three dimensional pattern extending across the entire face to provide an aesthetic face on the concrete unit. The patterned face on the first concrete unit and patterned face on the second concrete unit are mirror images of each other. The method further includes the step of orienting the first and second concrete units together so that the patterned face of the first concrete unit and the patterned face of the second concrete unit are aligned and against each other to nest and minimize the space between the adjacent edges of the first and second units.

A variety of examples of desirable product features or methods are set forth in part in the description that follows, and in part, will be apparent from the description, or may be learned by practicing various aspects of the disclosure. The aspects of the disclosure may relate to individual features as well as combinations of features. It is to be understood that both the forgoing general description and the following detailed description are explanatory only, and are not restrictive of the claimed invention.

DETAILED DESCRIPTION

Figure 5:
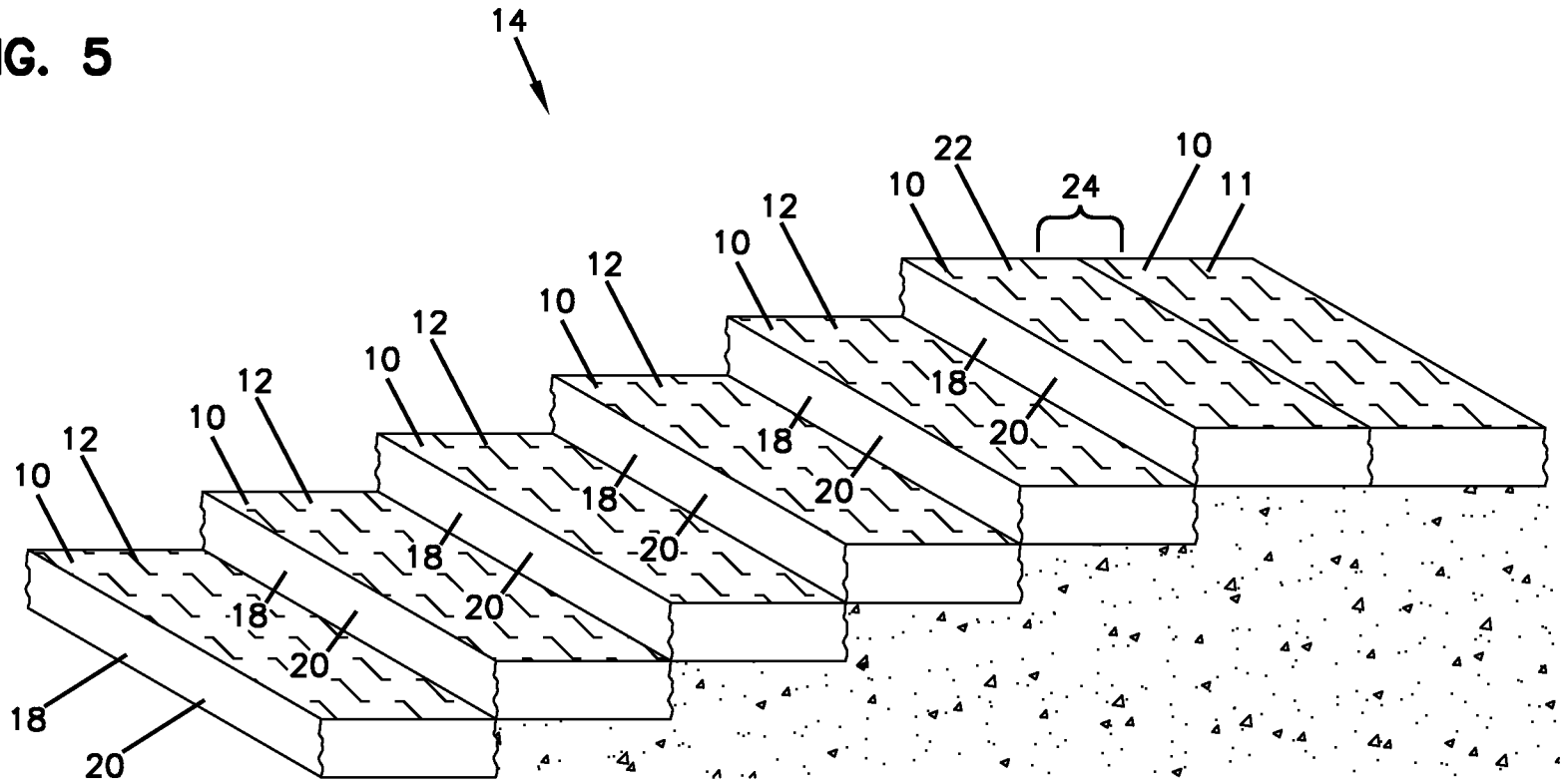
FIG. 5 is a schematic, perspective view showing concrete units, according to this disclosure, arranged as steps and an upper landing.

FIG. 5 illustrates an example of the use of concrete units, constructed in accordance with principles of this disclosure. FIG. 5 shows concrete units 10 arranged as steps 12 to form a staircase 14. Each concrete unit 10 has a face 18 that forms the riser 20 in the staircase 14. The face 18 forming the riser 20 has a three dimensional pattern that is aesthetically pleasing. At the top of the staircase 14 is a top step 22 and a second concrete unit 10, shown by reference numeral 11, which together form a landing. As will be explained in detail below, the concrete units 10 are constructed and arranged such that when two of the concrete units are placed with their patterned faces 18 aligned and in contact, the three dimensional patterns on the opposed faces nest to minimize the space between the adjacent edges of the units. This result can be seen in FIG. 5 at the joint 24 between the top step 22 and the adjacent concrete unit 11. It should be appreciated that, although the concrete units 10 are shown herein as part of staircase 14, the concrete units 10 can be used in many different implementations.

Figure 1:
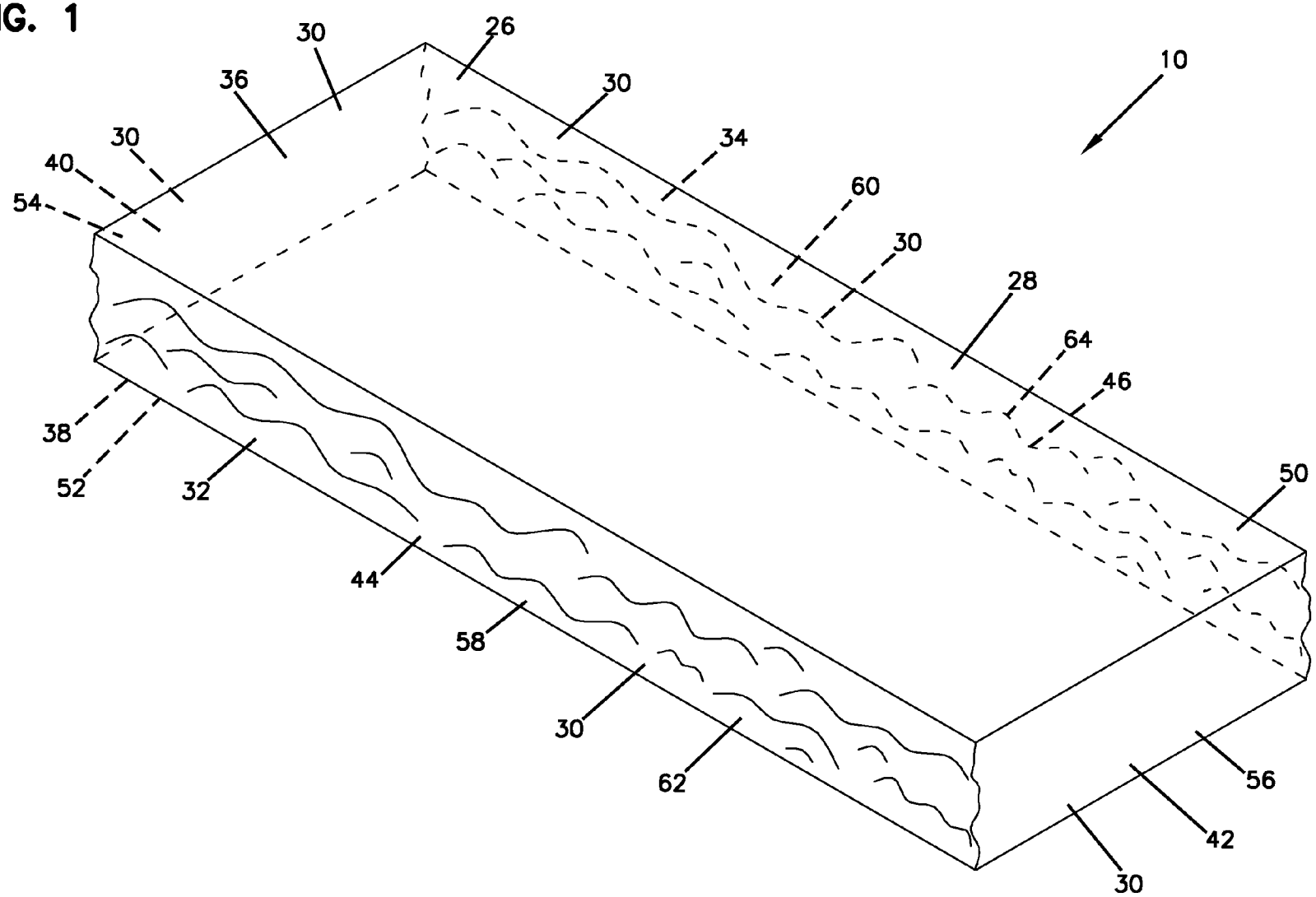
FIG. 1 is a perspective view of a concrete step unit, constructed in accordance with principles of this disclosure.

Attention is now directed to the concrete unit 10 shown in FIG. 1. The concrete unit 10 can be in the form of a block 26. The block 26 is made from concrete, preferably molded using dry cast concrete.

In FIG. 1, the concrete unit 10 is a six sided body 28. In other embodiments, there can be more than six sides, but in preferred embodiments, there will be no more than six sides. The six sided body 28 includes three pairs of opposed faces 30. The faces 30 are preferably rectangular, including square. The faces 30 include a first pair of opposed faces 32, 34; a second pair of opposed faces 36, 38; and a third pair of opposed faces 40, 42.

In this embodiment, the first pair of opposed faces 32, 34 are illustrated as being the front 44 and back 46 faces of the concrete unit 10. When the concrete unit 10 is used as steps 12, as shown in FIG. 5, the front face 44 will be the riser 20. The concrete unit 10 can be also oriented such that the back face 46 would be oriented so that it would be the riser 20. Either the front face 44 or back 46 face, in the use of FIG. 5, can be an exposure face, depending on how the unit is oriented. By the term "exposure face" it is meant the face of the concrete unit 10 that will have an appearance that is exposed for visibility and is not oriented directly against another of the concrete units 10 or is covered with earth.

The second pair of faces 36, 38, in the embodiment shown, will be the top and bottom faces 50, 52. The top face 50 and bottom face 52 extend between the front face 44 and back face 46.

The third pair of opposed faces 40, 42, in the embodiment shown, are first and second side faces 54, 56. The first side face 54 and second side face 56 extend between the front face 44 and back face 46 and between the top face 50 and bottom face 52.

In FIG. 1, the two opposed faces 32, 34 of the first pair of opposed faces of the body 20 each has an irregular three dimensional pattern extending across the entire face to provide two aesthetic faces 58, 60 on the concrete unit 10. By the term "irregular three dimensional pattern", it is meant a three-dimensional arrangement of physical attributes not contained within a single plane, which can include at least one peak projecting from a vertical plane normal to the plane of the second pair of faces, 38, 40 of at least 0.5 inch, and may further include a plurality of peaks or projections or smooth hills, some of which may be uniform in height or vary between 0.1 inch and up to 2 inches, for example; or a plurality of reliefs recessed from the peaks or projections or hills and a general non-planar contoured surface; such structure can include a craggy, irregular appearance, simulating a stone face, or for example, they can include a regular patterned appearance. The resulting appearance will be aesthetic. By "aesthetic," it is meant an appearance that is attractive to a human eye.

The two opposed faces of the first pair, 32, 34 that are the aesthetic faces 58, 60 have irregular three-dimensional patterns 62, 64 that are mirror images of each other. When two of the concrete units 10 are placed with their patterned faces 62, 64 aligned and in contact, the three-dimensional patterns 62, 64 on the opposed faces nest to minimize the space between the adjacent edges of the units. By the term "minimize", it is meant that there is little or no space between adjacent edges of the units 10. Little or no space typically will be a gap of less than 5 mm, often less than 2 mm, and preferably, under 1 mm.

Figure 2:
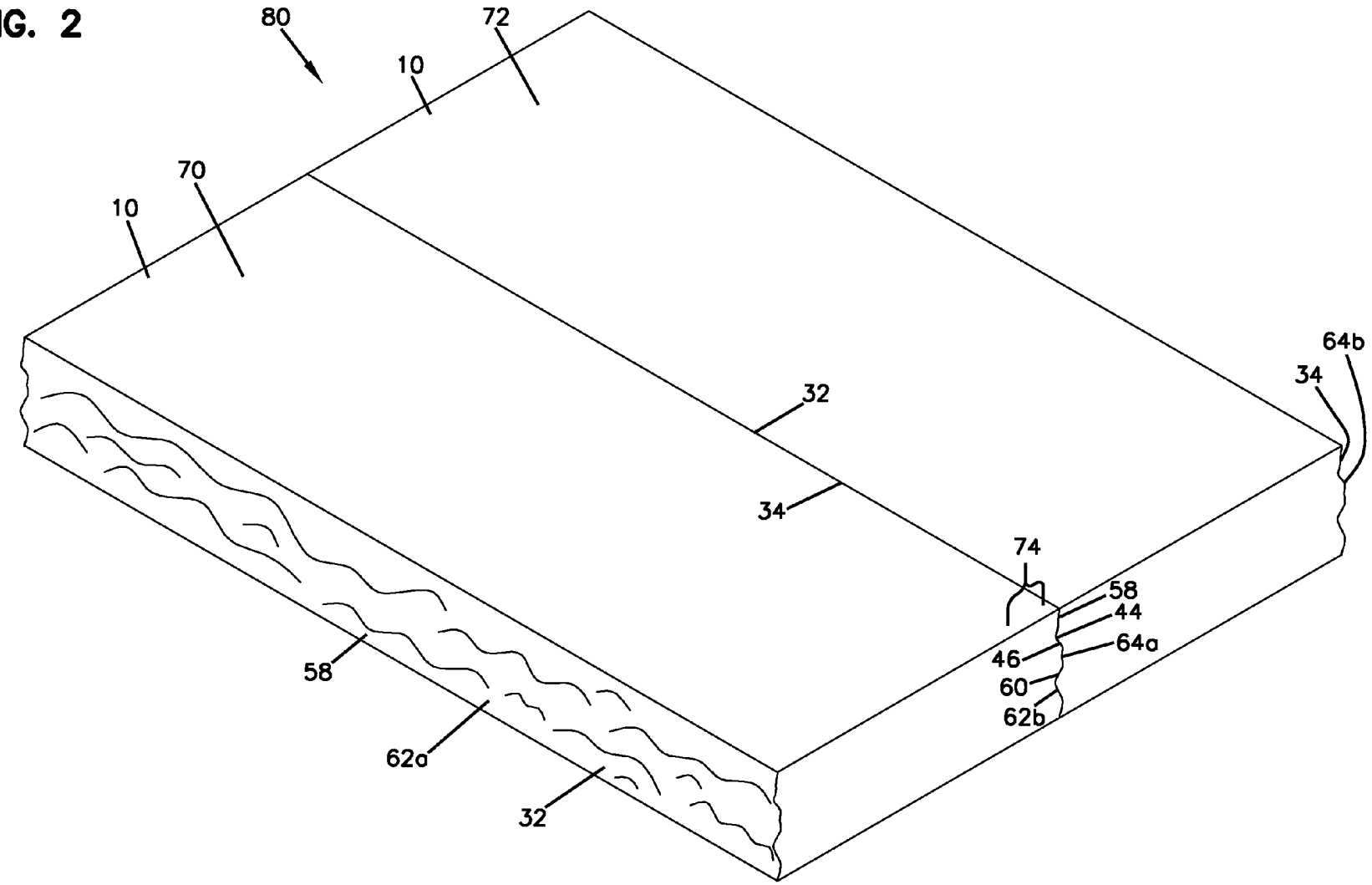
FIG. 2 is a perspective view of a set of assembled concrete step units, constructed in accordance with principles of this disclosure.
Figure 3:
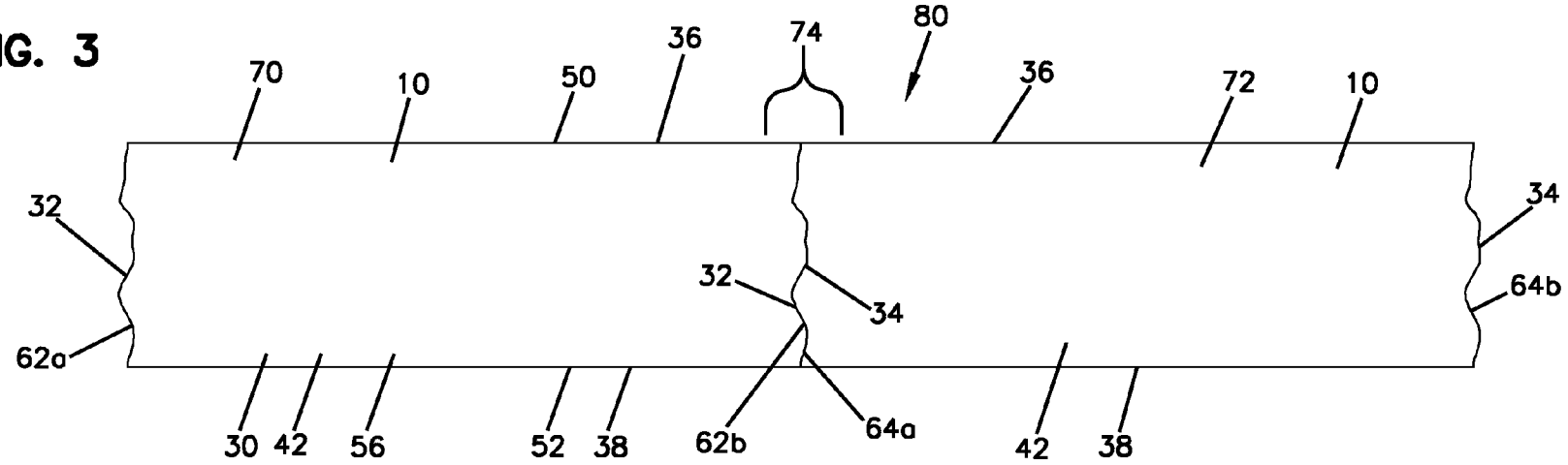
FIG. 3 is an end view of the set of concrete units of FIG. 2 showing the patterned faces aligned and in contact to minimize the space between the adjacent edges.

FIGS. 2 and 3 show two adjacent concrete units 10 having patterned faces 62, 64 aligned and in contact with each other. In FIGS. 2 and 3, a first concrete unit is shown at 70 having opposed patterned faces 62*a*, 64*a* and a second concrete unit is shown at 72 having opposed patterned faces 62*b*, 64*b*. The first concrete unit 70 has its irregular three dimensional patterned face 64*a* aligned with and in contact with the irregular three dimensional patterned face 62*b* of the second concrete unit 72, forming a joint 74. As can be seen in FIGS. 2 and 3, the joint 74 is seamless in appearance, in that the patterned face 64*a* of the first concrete unit 70 nests with the patterned face 62*b* of the second concrete unit 72. There is little or no space between adjacent edges of the units 70, 72.

Figure 4:
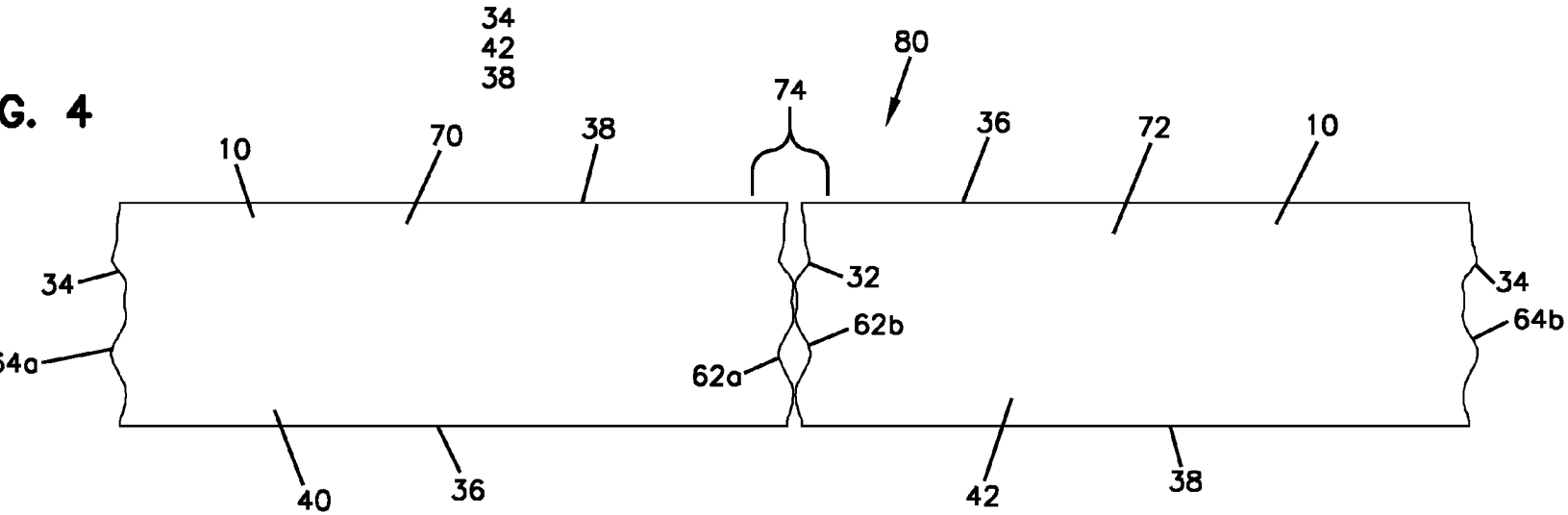
FIG. 4 is a side view of a set of concrete units that are not correctly aligned and which show the patterned faces not nesting with each other so that there are gaps between adjacent edges of the units.

FIG. 4 illustrates the concrete units 70, 72, with unit 72 with the top face 36 up and the other unit 70 with the top face 36 down so that the patterned face 62*a* of the first concrete unit 70 is adjacent and against the same patterned face 62*b* of the second concrete unit 72. Because the patterned faces 62*a*, 62*b* for the first concrete unit 70 and second unit 72 are the same, the patterned faces 62*a*, 62*b* do not nest with each other, and there are visible spaces or gaps at the joint 74. The visible spaces or gaps will typically be gaps greater than 5 mm. In order for the concrete units 70, 72 to be aligned so that the joint 74 is seamless in appearance, in FIG. 4, one of the units, in this example, unit 70 needs to be rotated 180° to orient the opposite patterned face 64*a* against the face 62*b* having its mirror image in the other concrete unit 72, 70.

The concrete unit 10 can be many different sizes and shapes. In preferred embodiments, the top face 36 of the step unit will be textured to further enhance the aesthetic appeal of the unit. The bottom face is 38 straight, flat, and without a projection extending therefrom. By "textured" it is meant that the top face 36 will not be flat but may include an irregular three dimensional pattern, as defined above.

In the embodiment shown, the third pair of opposed faces 40, 42 are straight, flat, and without a projection extending therefrom. In preferred embodiments, the third pair of faces 40, 42 are parallel to each other and planar. Of course, in other embodiments, the third pair of faces 40, 42, which form the first and second side faces 54, 56 can be non-parallel and angled toward each other.

The body 28 is preferably solid and free of any openings or cores. This is particularly useful when the body 28 is used as a step 12. In other arrangements, the body 28 may not be solid to reduce weight.

The concrete unit can be many different sizes. When used as step 12, the body 28 will have a length between the first side face 54 and second side face 56 of at least 3 feet, no greater than 5 feet, and typically about 4 feet. It will have a depth between the front face 44 and back face 46 of at least 1 foot, not greater than 2 feet, and typically about 18 inches. It will have a height between the top face 50 and bottom face 52 of at least 3 inches, not greater than 9 inches, and typically about 6 inches.

A set of concrete units is shown in FIGS. 2-4 at reference numeral 80. In FIG. 2, the first concrete unit 70 is shown as having a six sided body 28 with three pairs of opposed rectangular faces, and at least one of the faces (in this example, face 46) having the irregular three dimensional pattern 64*a* extending across the entire front face 46 to provide the aesthetic face 60. The second concrete unit 72 includes the six sided body 28 having three pairs of opposed rectangular faces, and at least one of the faces, in this case the face 44, having the irregular three dimensional pattern 62*b* extending across the entire face 44 to provide aesthetic face 62*b* on the second concrete unit 72. The patterned face 64*a* on the first concrete unit 70 and the patterned face 62*b* on the second concrete unit 72 are mirror images of each other so that when the first unit 70 and second unit 72 are placed with their patterned faces 64*a*, 62*b* aligned and in contact, the three dimensional patterns 64*a*, 62*b* on the aligned faces 46, 44 nest to minimize the space between the adjacent edges at the joint 74 of the first and second units 70, 72.

As can be appreciated from the description above, the first concrete unit 70 has a first pair of opposed faces 32, 34 with irregular three dimensional patterns 62*a*, 64*a* that are mirror images of each other. The second concrete unit 72 is constructed identically to the first concrete unit 70 and has a first pair of opposed faces 32, 34 with irregular three dimensional patterns 62*b*, 64*b* being mirror images of each other. The faces that align so that they minimize any space when the faces are in contact with each other are mirror images of each other as can be seen in FIGS. 2 and 3.

A method of assembling a concrete arrangement may include the concrete units 10 as described above. The method can include making an arrangement, such as steps 12 shown in FIG. 5. It may also include making a walking path with aligned concrete units. Many arrangements can be made with the concrete units 10.

In the method, there is a step of providing first concrete unit 70 and second concrete unit 72. Each of the concrete units 70, 72 is made in accordance with the concrete unit 10 as shown in FIG. 1. The method can include orienting the first and second concrete units 70, 72 together so that the patterned face 62*a* or 64*a* of the first concrete unit 70 and the patterned face 64*b*, 62*b* of the second concrete unit 72 are aligned and against each other to nest and minimize the space between the adjacent edges of the first and second concrete units 70, 72. The patterned faces of the units 70, 72 that are aligned against each other are mirror images of each other.

The step of providing the first concrete unit 70 includes providing the first concrete unit 70 to have the patterned face 62*a*, 64*a* to be part of the first pair of opposed faces 32, 34, and the opposed faces 32, 34 of the first pair being mirror images of each other. Similarly, the step of providing the second concrete unit 72 includes providing the second concrete unit 72 to have the patterned face 62*b*, 64*b* to be part of a first pair of opposed faces 32, 34 of the second concrete unit 72, with the opposed faces 32, 34 being mirror images of each other.

The above represents principles of this disclosure. Many embodiments can be made using these principles.

What is claimed is:

1. A concrete step unit comprising:

a six sided body having three pairs of opposed rectangular faces; a first pair of opposed faces being riser faces, a second pair of opposed faces being a bottom face and top step face, and a third pair of opposed faces being first and second side faces;

the two opposed riser faces each having an irregular three dimensional pattern with both projections and reliefs in a direction extending from the top step face to the bottom face and in a direction extending from the first side face to the second side face to provide two aesthetic faces on the unit, the two opposed riser faces having patterns that are mirror images of each other such that when two of the units are placed with their patterned faces aligned and in contact, the three dimensional patterns on the opposed riser faces nest to minimize the space between the adjacent edges of the units, the three dimensional patterns on the opposed riser faces having a shape that prevents movement between the opposed riser faces both laterally and vertically relative to a plane perpendicular to the bottom face; and the bottom face being straight, flat, and without a projection extending therefrom.

2. The concrete unit of claim 1 wherein top step face is textured.

3. The concrete unit of claim 1 wherein the first and second side faces are straight, flat and without a projection extending therefrom.

4. The concrete unit of claim 3 wherein the first and second side faces are parallel to each other.

5. The concrete unit of claim 4 wherein the first and second side faces are planar.

6. The concrete unit of claim 1 wherein the six sided body has a length of 3-5 feet, a depth of 1-2 feet, and a height of 3-9 inches.

7. The concrete unit of claim 1 wherein the six sided body has no more than six sides.

8. The concrete unit of claim 1 wherein the six sided body is solid and core-free.

9. The concrete unit of claim 1 wherein the six sided body comprises a molded dry cast concrete unit.

10. The concrete unit of claim 1 wherein the three dimensional pattern on the riser faces are each being craggy in appearance and simulate a stone face.

11. A set of concrete units comprising:

(a) a first concrete unit comprising a six sided body having three pairs of opposed rectangular faces; at least one of the faces having an irregular three dimensional pattern extending across the entire face to provide an aesthetic face on the first concrete unit, (b) a second concrete unit comprising a six sided body having three pairs of opposed rectangular faces; at least one of the faces having an irregular three dimensional pattern extending across the entire face to provide an aesthetic face on the second concrete unit, and (c) the patterned face on the first concrete unit and the patterned face on the second concrete unit being mirror images of each other such that when the first unit and second unit are placed with their patterned faces aligned and in contact, the three dimensional patterns on the aligned faces nest to minimize the space between the adjacent edges of the first and second units, the three dimensional patterns on the aligned faces having a shape that prevents movement between the aligned faces both laterally and vertically.

12. The set of concrete units of claim 11 wherein:

(a) the first concrete unit includes at least two opposed faces that are straight, flat and without a projection extending therefrom; and (b) the second concrete unit includes at least two opposed faces that are straight, flat and without a projection extending therefrom.

13. The set of concrete units of claim 11 wherein:

(a) the first concrete unit includes at least three faces that are straight, flat and without a projection extending therefrom; and (b) the second concrete unit includes at least three faces that are straight, flat and without a projection extending therefrom.

14. The set of concrete units of claim 11 wherein:

(a) the first concrete unit patterned face is in a first pair of opposed faces, and the opposed faces of the first pair are mirror images; and (b) the second concrete unit patterned face is in a first pair of opposed faces of the second concrete unit, and the opposed faces of the first pair of opposed faces of the second concrete unit are mirror images.

15. The set of concrete units of claim 11 wherein:

(a) the first concrete unit comprises a molded dry cast concrete unit; and (b) the second concrete unit comprises a molded dry cast concrete unit.

16. A method of assembling a concrete arrangement, the method comprising:

(a) providing a first concrete unit comprising a six sided body having three pairs of opposed rectangular faces; at least one of the faces having an irregular three dimensional pattern extending across the entire face to provide an aesthetic face on the first concrete unit, (b) providing a second concrete unit comprising a six sided body having three pairs of opposed rectangular faces; at least one of the faces having an irregular three dimensional pattern extending across the entire face to provide an aesthetic face on the second concrete unit, the patterned face on the first concrete unit and the patterned face on the second concrete unit being mirror images of each other; and (c) orienting the first and second concrete units together so that the patterned face of the first concrete unit and the patterned face of the second concrete unit are aligned and against each other to nest and minimize the space between the adjacent edges of the first and second units and to prevent movement between the aligned faces both laterally and vertically.

17. The method of claim 16 wherein:

(a) the step of providing a first concrete unit includes providing the first concrete unit to have the patterned face be part of a first pair of opposed faces, and the opposed faces of the first pair being mirror images of each other; and (b) the step of providing a second concrete unit includes providing the second concrete unit to have the patterned face be part of a first pair of opposed faces of the second concrete unit, and the opposed faces of the first pair of opposed faces of the second concrete unit being mirror images of each other.

* * * * *